US011761620B2

(12) United States Patent
Vanacore

(10) Patent No.: US 11,761,620 B2
(45) Date of Patent: Sep. 19, 2023

(54) WATERPROOF PCB (LED) LIGHT

(71) Applicant: William Vanacore, Hahira, GA (US)

(72) Inventor: William Vanacore, Hahira, GA (US)

( * ) Notice: Subject to any disclaimer, the term of this patent is extended or adjusted under 35 U.S.C. 154(b) by 253 days.

(21) Appl. No.: 16/445,449

(22) Filed: Jun. 19, 2019

(65) Prior Publication Data

US 2020/0400301 A1 Dec. 24, 2020

Related U.S. Application Data

(60) Provisional application No. 62/697,451, filed on Jul. 13, 2018.

(51) Int. Cl.

| | |
|---|---|
| ***F21V 31/00*** | (2006.01) |
| ***F21V 29/56*** | (2015.01) |
| *F21Y 115/10* | (2016.01) |

(52) U.S. Cl.

CPC ..... *F21V 31/005* (2013.01); *F21V 29/56* (2015.01); *F21Y 2115/10* (2016.08)

(58) Field of Classification Search

CPC ..... F21V 31/005; F21V 29/56; F21Y 2115/10

See application file for complete search history.

(56) References Cited

U.S. PATENT DOCUMENTS

| | | | | |
|---|---|---|---|---|
| 6,203,170 | B1 * | 3/2001 | Patrick | A01K 79/02 362/234 |
| 9,316,387 | B1 * | 4/2016 | Olsson | F21V 31/005 |
| 9,746,170 | B1 * | 8/2017 | Armer | F21V 29/503 |
| 2006/0187653 | A1 * | 8/2006 | Olsson | F21V 5/041 362/111 |
| 2009/0027900 | A1 * | 1/2009 | Janos | F21V 29/773 362/373 |
| 2015/0233565 | A1 * | 8/2015 | Lee | F21V 31/04 362/555 |

* cited by examiner

*Primary Examiner* — Kevin Quarterman

(57) ABSTRACT

Low cost easy to use long battery life underwater night fishing light. This underwater light is extremely lightweight and dissipates heat very effectively. No more need for heavy metal plates called heat sink. These lights are so light they will float or can be used up to 60' deep. Cost and energy efficient for hours and hours of enjoyment.

1 Claim, 1 Drawing Sheet

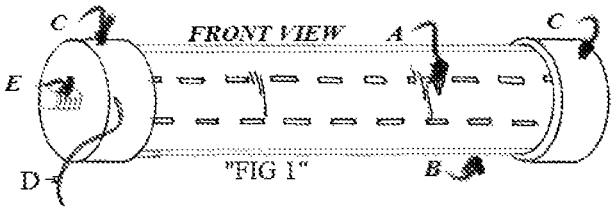
"FIG 1"
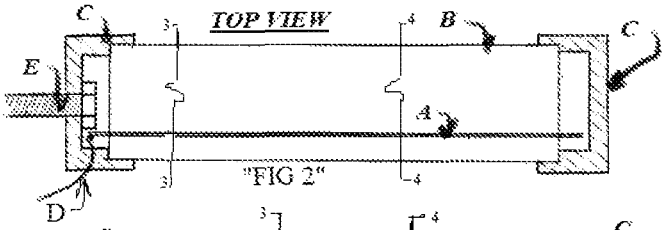
"FIG 2"
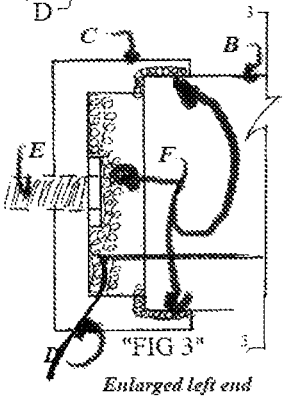
"FIG 3"
Enlarged left end
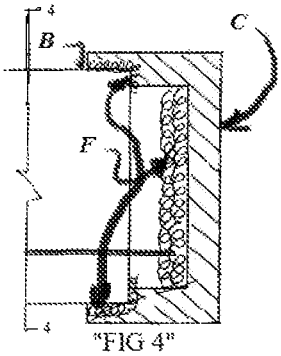
"FIG 4"
Enlarged Right End

WATERPROOF PCB (LED) LIGHT

For years flounder gigging was done using any kind of light available from coleman lanterns to flashlights. Today we now have new LED lights and have come a long way toward making things easier. However the LED lights on the market now have a problem dissipating heat the heat built up from the high powered LEDs and currently are using something called a heat sink. This is a fairly large thick aluminum metal bar that the led boards are secured too. This makes them heavy and very cumbersome at best is hard to carry for any length of time. This usually makes for a shorter fishing trip.

I have designed a small super powerful led light that dissipates heat almost magically but also floats or can be used up to 60 foot deep. Weighs only ounces and is affordable for everyone.

BACKGROUND OF THE INVENTION

The present invention relates to the dissipation of heat generated by the use of high output leds. Everything up till now was limited by size and weight to keep cool. Several other factors also relate to why my product is a improvement overall to what is offered For years gigging for flounder at night you had to have perfect conditions. You needed clear water, tides that were right and absolutely no wind, Not even a breeze! Wind was always a bigger problem than anything else because most giggers used lights that were above the water. This made even the smallest ripples on the surface make a drastic difference on the bottom. The more wind the worse. Some people could afford expensive under water lights but they tended to break when hitting obstacles like rocks or oyster bars and fisherman could not go into really shallow water.

These lights will dissipate heat very efficiently and float so they can be used in as little as 2" of water. They can be used wading, in a boat, on a pier, from a dock almost anywhere. Seams like an Improvement to me.

BRIEF DESCRIPTION OF THE DRAWINGS

FIG. 1 shows a front view of the waterproof PCB (LED) light.

FIG. 2 shows a top view of the waterproof PCB (LED) light.

FIG. 3 shows an enlarged left end view of the waterproof PCB (LED) light.

FIG. 4 shows an enlarged right end view of the waterproof PCB (LED) light.

LIST OF REFERENCE SYMBOLS

A. LED PCB Board Manufactured and furnished by others.
B. Clear Hard Plastic Tubing IE: Polycarbonate/acrylic.
C. Hard Plastic End Caps IE: PVC, ABS or equal sealed to prevent water entry.

D. Power wire supplying voltage to board. E. Bolt to Secure Light. F Two Part Epoxy used to seal between components.

DETAILED DESCRIPTION OF THE INVENTION

"A" Heat Dissipated from light board thru end caps "C" by seal of a 2 part epoxy seal between both. This transfers heat into water.

"B" Heat Dissipated from end caps into tubing "B" by 2 part epoxy seal between both allowing for heat transfer as well as the close proximity of the board to the tube also allows for transfer of heat from board to tube wall then into water.

"D" Min. 18 gauge wire will be used but size will be determined by the amp draw of each individual light. Where the wire penetrates the cap "C" it will be sealed by 2 part epoxy making it waterproof.

"E" Bolt for securing light will be stainless steel, threaded and the head will be embedded into 2 part epoxy for complete waterproof seal as well as help with heat transfer.

A method of dissipating heat generated from high powered LEDs into an underwater area includes providing a waterproof PCB (LED) light by the steps of providing the LEDs on a metal board within a clear plastic tubing; providing an end cap on each end of the clear plastic tubing and metal board; and securing the metal board to the end caps as well as sealing the light from moisture by using 2 part epoxy between the metal board and the end cap and the end caps to the clear tubing, where the clear plastic tubing allows the light to penetrate the exterior of the plastic, tubing and illuminate the underwater area, and where the heat generated by the metal board is dissipated through the end caps and clear plastic tubing into the water.

It should be understood, of course, that the foregoing relates to the exemplary embodiments of the invention and that modifications may be made without departing from the spirt and scope of the invention as set forth in the following claim.

What is claimed:

1. A method of dissipating heat generated from high powered LEDs into an underwater area comprising:

providing the LEDs on a metal board within a clear plastic tubing;

providing an end cap on each end of the clear plastic tubing and metal board; and securing the metal board to the end caps as well as sealing the light from moisture by using 2 part epoxy between the metal board and the end caps and the end caps to the clear plastic tubing, wherein the clear plastic tubing allows the light to penetrate the exterior of the clear plastic tubing and illuminate the underwater area, and wherein the heat generated by the metal board is dissipated through the end caps and clear plastic tubing into the water.

* * * * *